US007377403B2

(12) United States Patent
Gorrie

(10) Patent No.: US 7,377,403 B2
(45) Date of Patent: May 27, 2008

(54) TOOTHPASTE TUBE SQUEEZER AND METHOD FOR EFFICIENTLY REMOVING TOOTHPASTE FROM A TOOTHPASTE TUBE

(76) Inventor: Megan Alexandria Gorrie, 691 N. Tatum La., Gilbert, AZ (US) 85234

( * ) Notice: Subject to any disclaimer, the term of this patent is extended or adjusted under 35 U.S.C. 154(b) by 380 days.

(21) Appl. No.: 11/184,326

(22) Filed: Jul. 19, 2005

(65) Prior Publication Data

US 2007/0017930 A1 Jan. 25, 2007

(51) Int. Cl.
*B65D 35/28* (2006.01)
*B25B 1/10* (2006.01)

(52) U.S. Cl. ..... 222/103; 269/143; 269/249; 251/9

(58) Field of Classification Search ..... 269/139, 269/143, 249; 29/257, 276; 222/103, 105; 251/7, 8, 9
See application file for complete search history.

(56) References Cited

U.S. PATENT DOCUMENTS 3,734,351 A * 5/1973 Gaudin ..... 222/103
3,768,699 A * 10/1973 Robe, Jr. ..... 222/103
3,908,863 A * 9/1975 White ..... 222/103
5,248,065 A * 9/1993 Zima ..... 222/103
5,312,097 A * 5/1994 Womack ..... 269/139
7,055,787 B2 * 6/2006 Cross ..... 248/226.11

* cited by examiner

*Primary Examiner*—Kenneth Bomberg
*Assistant Examiner*—Hyea J Choi
(74) *Attorney, Agent, or Firm*—Schwegman, Lundberg & Woessner, P.A.

(57) ABSTRACT

A toothpaste tube squeezer has first and second squeezing blocks for holding a toothpaste tube therebetween. A first clamping mechanism is positioned toward an opening end of the toothpaste tube to apply pressure to the first and second squeezing blocks to squeeze the toothpaste tube. A second clamping mechanism is positioned toward a sealed end of the toothpaste tube to release pressure on the blocks. Both squeezing blocks may have slightly outwardly curved surfaces to contact the toothpaste tube. As the second clamping mechanism is loosened to release pressure applied at the sealed end of the toothpaste tube, a gap may increase between the squeezing blocks at the sealed end of the toothpaste tube. Due to the slightly curved surfaces of the squeezing blocks and the increasing gap, a squeezing pressure moves further up the toothpaste tube in a direction from the sealed end to the opening end.

1 Claim, 2 Drawing Sheets

TOOTHPASTE TUBE SQUEEZER AND METHOD FOR EFFICIENTLY REMOVING TOOTHPASTE FROM A TOOTHPASTE TUBE

TECHNICAL FIELD

The present invention pertains to apparatus for efficiently removing toothpaste from a toothpaste tube.

BACKGROUND

One problem with toothpaste tubes is that it is difficult to remove the toothpaste efficiently from the tube. Many times, a person applies pressure to the middle of the tube leaving toothpaste at the sealed end of the tube. Applying pressure with your hands at the sealed end of the tube becomes less effective as less toothpaste remains in the tube. Thus there are general needs for apparatus and methods that can efficiently remove toothpaste a toothpaste tube.

SUMMARY

The present invention provides a toothpaste tube squeezer having first and second squeezing blocks for holding a toothpaste tube therebetween. A first clamping mechanism is positioned toward an opening end of the toothpaste tube to apply pressure to the first and second squeezing blocks to squeeze the toothpaste tube. A second clamping mechanism is positioned toward a sealed end of the toothpaste tube to release pressure on the first and second squeezing blocks. Both first and second squeezing blocks may have slightly outwardly curved surfaces to contact the toothpaste tube. As the second clamping mechanism is loosened to release pressure applied to the first and second squeezing blocks at the sealed end of the toothpaste tube, a gap may increase between the first and second squeezing blocks at the sealed end of the toothpaste tube. Due to the slightly curved surfaces of the squeezing blocks and the increasing gap, a squeezing pressure moves further up the toothpaste tube in a direction from the sealed end to the opening end as the first clamping mechanism is tightened and as the second clamping mechanism is loosened.

DETAILED DESCRIPTION

The following description and the drawings illustrate specific embodiments of the invention sufficiently to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. Embodiments of the invention set forth in the claims encompass all available equivalents of those claims. Embodiments of the invention may be referred to, individually or collectively, herein by the term "invention" merely for convenience and without intending to limit the scope of this application to any single invention or inventive concept if more than one is in fact disclosed.

Figure 1:
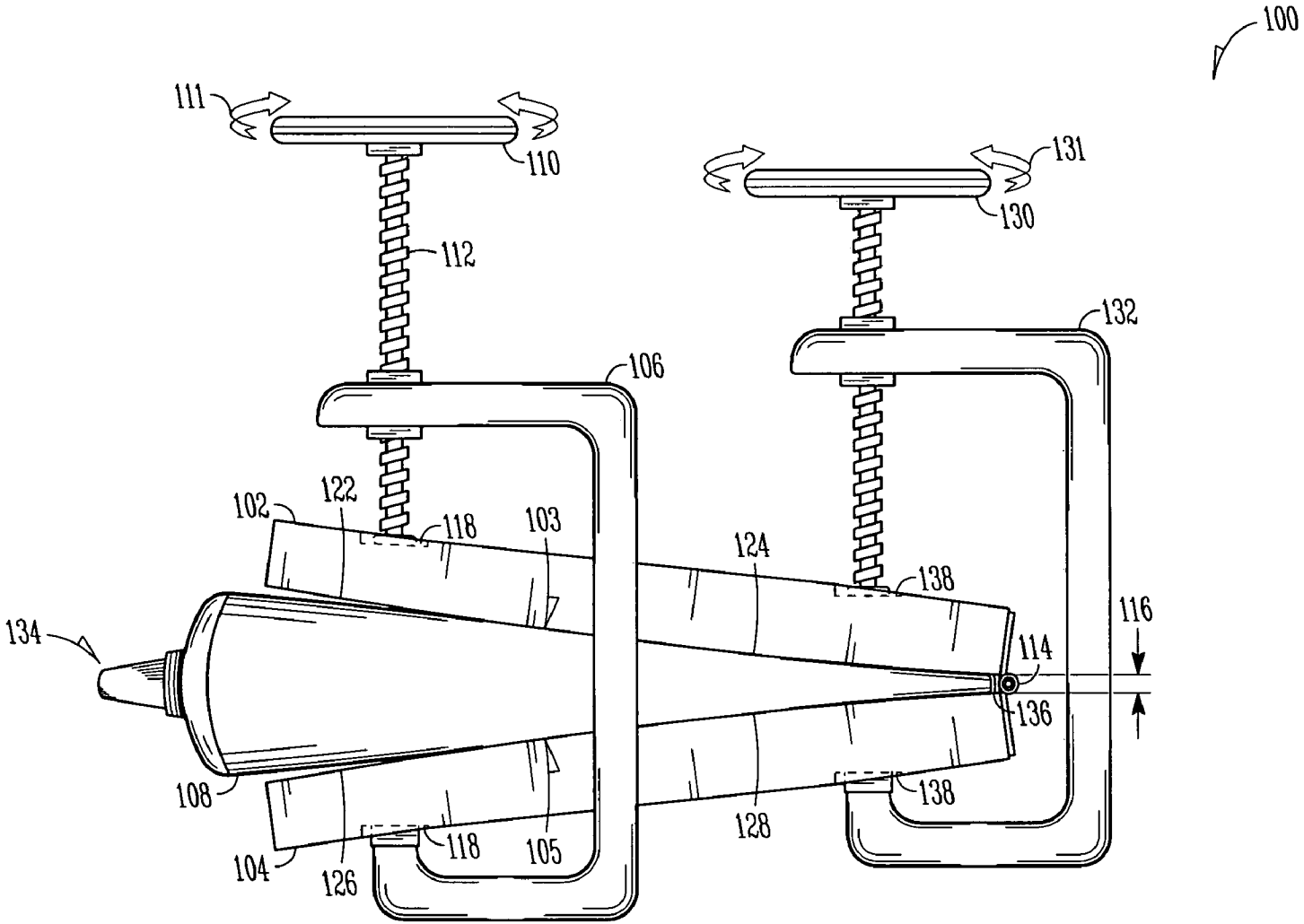
FIG. 1 illustrates a toothpaste tube squeezer in accordance with some embodiments of the present invention.

FIG. 1 illustrates a toothpaste tube squeezer in accordance with some embodiments of the present invention. Toothpaste tube squeezer 100 comprises first and second squeezing blocks 102 & 104 for holding and/or retaining toothpaste tube 108 therebetween, first clamping mechanism 106 to apply pressure to first and second squeezing blocks 102 & 104 to squeeze toothpaste tube 108, and second clamping mechanism 132 to release pressure on first and second squeezing blocks 102 & 104. In some embodiments, the width of squeezing blocks 102 & 104 may be at least as great as the width of toothpaste tube 108.

In some embodiments, at least one of squeezing blocks 102 & 104 has a slightly curved, such as surface 103, with a convex curvature to contact toothpaste tube 108. In some alternate embodiments, surfaces 103 & 105 of squeezing blocks 102 & 104 that contact toothpaste tube 108 are both substantially flat, although the scope of the invention is not limited in this respect.

In some embodiments, first clamping mechanism 106 has first knob 110 which when turned in first direction 111, applies pressure to first and second squeezing blocks 102 & 104 to squeeze toothpaste tube 108. First clamping mechanism 106 may be positioned toward opening end 134 of toothpaste tube 108.

In some embodiments, second clamping mechanism 132 has second knob 130 and may be positioned toward sealed end 136 of toothpaste tube 108. Second knob 130 may be turned in second opposite direction 131 to release pressure applied to first and second squeezing blocks 102 & 104 to either cause or increase gap 116 between first and second squeezing blocks 102 & 104 at sealed end 136 of toothpaste tube 108. Due to slightly curved surface 103 of at least one of squeezing blocks 102 & 104, a squeezing pressure moves further up toothpaste tube 108 in a direction from sealed end 136 to opening end 134 as first knob 110 is turned in first direction 111 and as second knob 130 is turned in second opposite direction 131. In some embodiments, gap 116 may initially be closed when toothpaste tube 108 is initially inserted in squeezer 100. Gap 116 may be allowed to increase as clamping mechanism 106 is tightened and as clamping mechanism 132 is loosened, although the scope of the invention is not limited in this respect. Clamping mechanisms 106 and 132 may have threads 112.

In some embodiments, both first and second squeezing blocks 102 & 104 may have slightly outwardly curved surfaces 103 & 105, respectively, to contact toothpaste tube 108. In some embodiments, slightly outwardly curved surfaces 103 & 105 may be more curved at portions 122 and 126 toward opening end 134 of toothpaste tube 108. Slightly outwardly curved surfaces 103 & 105 may be less curved at portions 124 and 128 toward the sealed end 136 of toothpaste tube 108, although the scope of the invention is not limited in this respect. In these embodiments, the curvature of surfaces 103 and 105 is not necessarily uniform. Greater curvature may be provided toward opening end 134 and less curvature may be provided at sealed end 136 of toothpaste tube 108. In alternate embodiments, greater curvature may be provided toward sealed end 136 and less curvature may be provided at opening end 134 of toothpaste tube 108, although the scope of the invention is not limited in this respect. In some embodiments, both first and second squeezing blocks 102 & 104 may be made from wood, although the scope of the invention is not limited in this respect.

Although embodiments of the present invention are described with respect to toothpaste tubes, the scope of the invention is not limited in this respect. The present invention may be applicable to any type of tube.

In some embodiments, first and second clamping mechanisms 106 & 132 may comprise, respectively, first and second C-clamps, although almost any clamping or tightening device may be used. In some embodiments, first direction 111 may be clockwise to tighten the first C-clamp, and second direction 131 may be counterclockwise to slightly loosen the second C-clamp.

In some embodiments, first and second squeezing blocks 102 & 104 may have recesses 118 & 138 to locate first and second clamping mechanisms 106 & 132 on the squeezing blocks.

In some embodiments, toothpaste tube squeezer 100 may further comprise hinge 114 loosely coupling first and second squeezing blocks 102 & 104 at sealed end 136 of toothpaste tube 108. Loosely coupled hinge 114 may allow gap 116 to increase as the first clamping mechanism 106 is tightened and second clamping mechanism 132 is slightly loosened.

Figure 2:
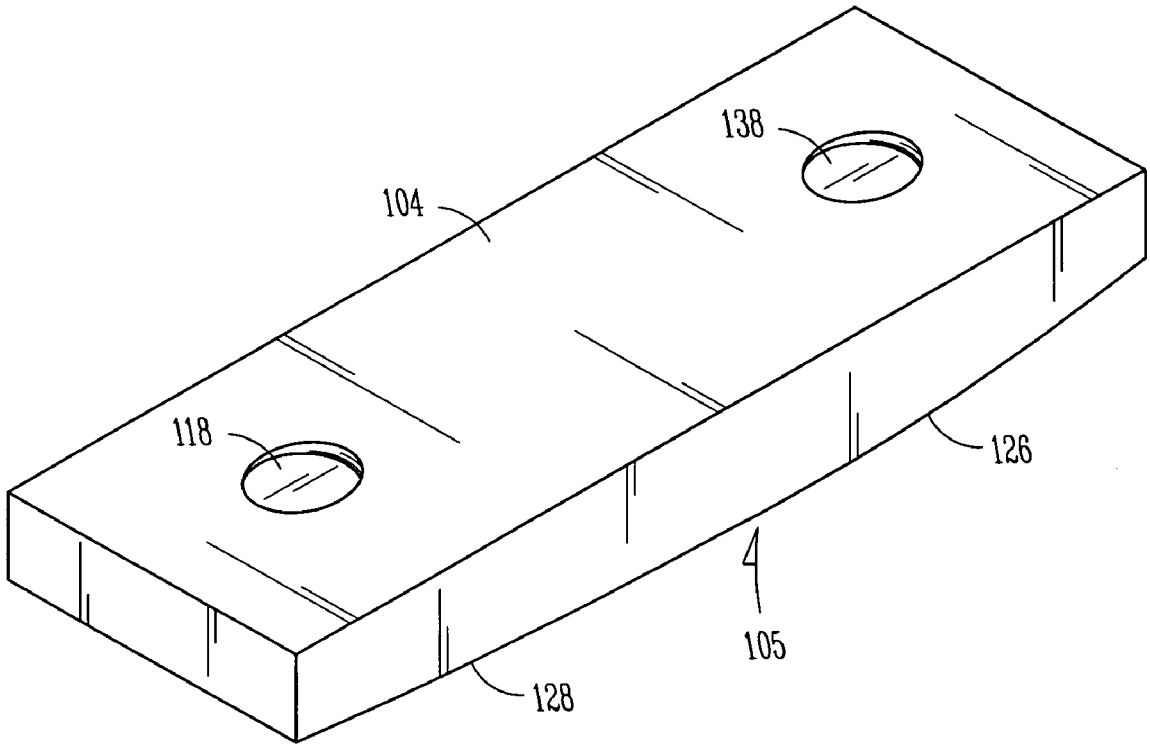
FIG. 2 illustrates a squeezing block suitable for use as part of the toothpaste tube squeezer of FIG. 1 in accordance with some embodiments of the present invention.

FIG. 2 illustrates a squeezing block suitable for use as part of the toothpaste tube squeezer of FIG. 1 in accordance with some embodiments of the present invention. Squeezing block 104 may be suitable for use as squeezing block 102 (FIG. 1) and/or squeezing block 104 (FIG. 1).

Embodiments of the present invention also provide a method of efficiently removing toothpaste from a toothpaste tube. The method may comprise initially inserting the toothpaste tube between first and second squeezing blocks, applying pressure to the first and second squeezing blocks toward an opening end of the toothpaste tube to squeeze the toothpaste tube with a first clamping mechanism, and releasing pressure on the first and second squeezing blocks toward an sealed end of the toothpaste tube with a second clamping mechanism. At least one of the squeezing blocks may have a slightly curved surface to contact the toothpaste tube.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims.

In the foregoing detailed description, various features may be occasionally grouped together in a single embodiment for the purpose of streamlining the disclosure. This method of disclosure is not to be interpreted as reflecting an intention that the claimed embodiments of the subject matter require more features than are expressly recited in each claim. Rather, as the following claims reflect, invention may lie in less than all features of a single disclosed embodiment. Thus the following claims are hereby incorporated into the detailed description, with each claim standing on its own as a separate preferred embodiment.

What is claimed is:

1. A toothpaste tube squeezer comprising:

first and second squeezing blocks for holding a toothpaste tube therebetween;

a first clamping mechanism to apply pressure to the first and second squeezing blocks to squeeze the toothpaste tube; and a second clamping mechanism to release pressure on the first and second squeezing blocks, wherein both of the squeezing blocks are rigid and have a slightly curved surface to contact the toothpaste tube, wherein the slightly curved surfaces extend an entire length of the squeezing blocks, wherein the first clamping mechanism has a first knob which when turned in a first direction, applies pressure to the first and second squeezing blocks to squeeze the toothpaste tube, wherein the first clamping mechanism is positioned toward an opening end of the toothpaste tube, wherein the second clamping mechanism has a second knob and is positioned toward a sealed end of the toothpaste tube, wherein the second knob is turned in a second opposite direction to release pressure applied to the first and second squeezing blocks to either cause or increase a gap between the first and second squeezing blocks at the sealed end of the toothpaste tube, wherein due to the slightly curved surfaces of the squeezing blocks, a squeezing pressure moves further up the toothpaste tube as the first knob is turned in the first direction and as the second knob is turned in the second opposite direction, wherein the gap is initially closed when toothpaste tube is inserted in toothpaste tube squeezer, wherein the gap is to increase as the first clamping mechanism is tightened when the first knob is turned in the first direction and as the second clamping mechanism is slightly loosened when the second knob is turned in the second opposite direction, wherein the first and second clamping mechanisms comprise, respectively, first and second C-clamps, wherein the first direction is clockwise to tighten the first C-clamp, and wherein the second direction is counterclockwise to slightly loosen the second C-clamp, wherein the slightly outwardly curved surfaces are more curved toward the opening end of the toothpaste tube, wherein the slightly outwardly curved surfaces are less curved toward the sealed end of the toothpaste tube, wherein the first and second squeezing blocks each have recesses to locate the first and second clamping mechanisms, and wherein the toothpaste tube squeezer further comprises a hinge loosely coupling the first and second squeezing blocks at the sealed end of the toothpaste tube, the loosely coupled hinge allowing the gap to increase as the first clamping mechanism is tightened and as the second clamping mechanism is loosened.

* * * * *